US009773374B2

(12) United States Patent
Stone

(10) Patent No.: US 9,773,374 B2
(45) Date of Patent: Sep. 26, 2017

(54) SLOT MACHINE

(71) Applicant: Allen Stone, Wakefield, MA (US)

(72) Inventor: Allen Stone, Wakefield, MA (US)

( * ) Notice: Subject to any disclaimer, the term of this patent is extended or adjusted under 35 U.S.C. 154(b) by 350 days.

(21) Appl. No.: 14/686,968

(22) Filed: Apr. 15, 2015

(65) Prior Publication Data

US 2016/0307403 A1 Oct. 20, 2016

(51) Int. Cl.
*G07F 17/32* (2006.01)
*G07F 17/34* (2006.01)

(52) U.S. Cl.
CPC ..... *G07F 17/3244* (2013.01); *G07F 17/326* (2013.01); *G07F 17/34* (2013.01)

(58) Field of Classification Search
USPC ..... 463/20
See application file for complete search history.

(56) References Cited

U.S. PATENT DOCUMENTS 5,212,636 A 5/1993 Nakazawa
6,056,642 A 5/2000 Bennett
6,871,194 B1 3/2005 Cardno
7,857,696 B2 12/2010 Tarantino
8,376,839 B2 2/2013 Lesley et al.
8,532,798 B2 9/2013 Ferraro, III et al.
8,713,707 B2 4/2014 Hamalainen et al.
9,495,843 B2 * 11/2016 Itagaki ..... G07F 17/34
2009/0186679 A1 7/2009 Irvine et al.
2012/0123567 A1 5/2012 Nayak et al.
2013/0254146 A1 9/2013 Ellis et al.
2014/0342802 A1 * 11/2014 Itagaki ..... G07F 17/3267 463/20
2015/0213692 A1 * 7/2015 Itagaki ..... G07F 17/34 463/20
2015/0371491 A1 * 12/2015 Itagaki ..... G07F 17/34 463/20
2016/0284167 A1 * 9/2016 Mio ..... G07F 17/3255

FOREIGN PATENT DOCUMENTS

EP 1054368 11/2000
WO 2004104721 12/2004
WO 2006102441 9/2006

* cited by examiner

*Primary Examiner* — Pierre E Elisca
(74) *Attorney, Agent, or Firm* — Lambert & Associates; Gary E. Lambert; David J. Connaughton, Jr.

(57) ABSTRACT

A slot machine device providing a unique operation, payout scheme, and structure. This slot machine provides optional, unique game play features. These features may include a Notice feature which informs a player if the next cycle will be a win or a loss; a Flush feature allowing a player to discard a losing cycle; and a Do-Over feature, allowing a player to replay a cycle if they do not like the results of the prior cycle. These features may be turned on and off, and the slot machine may be configured to automatically adjust a payout option depending on what features are activated.

20 Claims, 4 Drawing Sheets

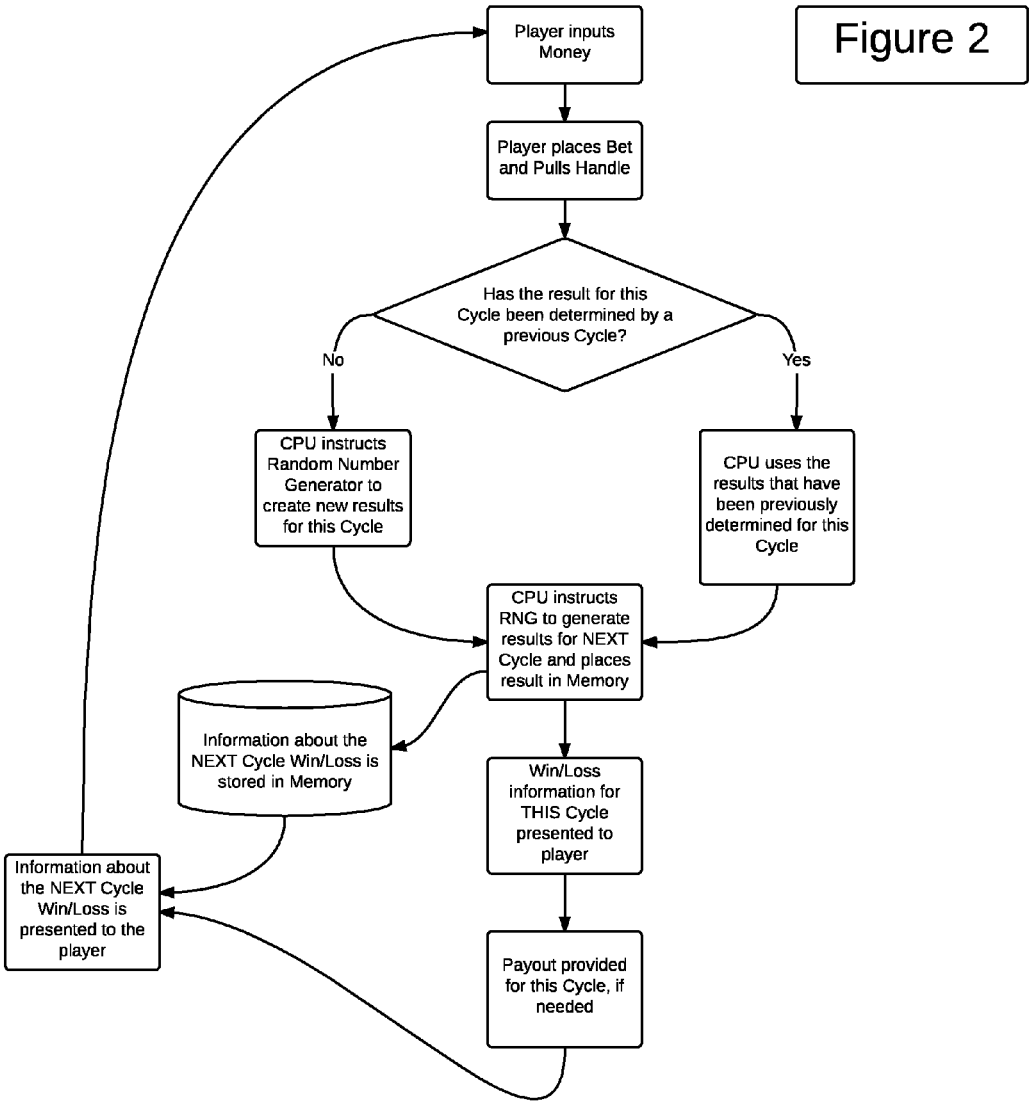
Figure 2
Player inputs Money
Player places Bet and Pulls Handle
Has the result for this Cycle been determined by a previous Cycle?
No
Yes
CPU instructs Random Number Generator to create new results for this Cycle
CPU uses the results that have been previously determined for this Cycle
CPU instructs RNG to generate results for NEXT Cycle and places result in Memory
Information about the NEXT Cycle Win/Loss is stored in Memory
Win/Loss information for THIS Cycle presented to player
Information about the NEXT Cycle Win/Loss is presented to the player
Payout provided for this Cycle, if needed

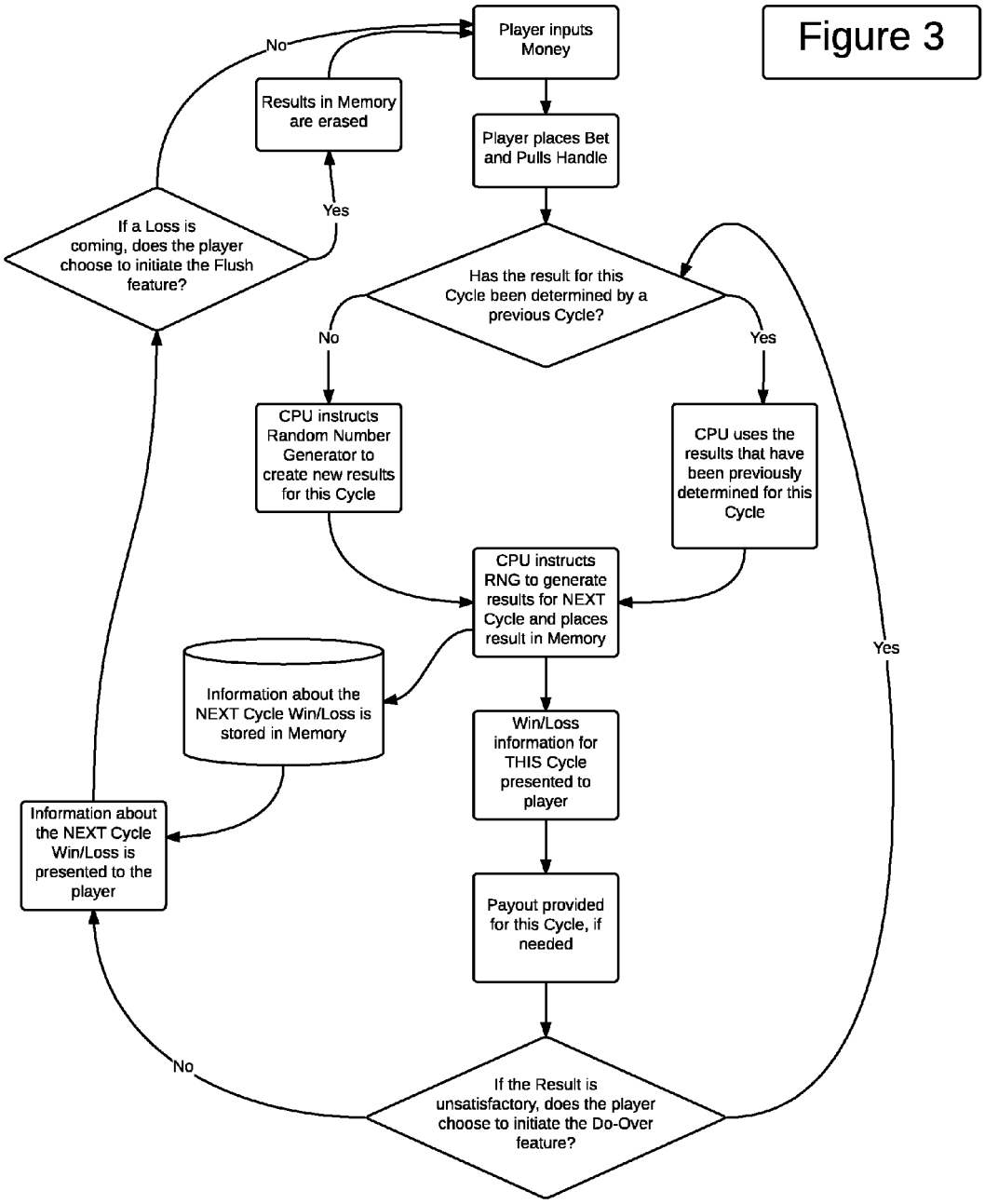
Figure 3
Player inputs Money
Player places Bet and Pulls Handle
Has the result for this Cycle been determined by a previous Cycle?
No
Yes
CPU instructs Random Number Generator to create new results for this Cycle
CPU uses the results that have been previously determined for this Cycle
CPU instructs RNG to generate results for NEXT Cycle and places result in Memory
Information about the NEXT Cycle Win/Loss is stored in Memory
Win/Loss information for THIS Cycle presented to player
Payout provided for this Cycle, if needed
If the Result is unsatisfactory, does the player choose to initiate the Do-Over feature?
No
Yes
Information about the NEXT Cycle Win/Loss is presented to the player
If a Loss is coming, does the player choose to initiate the Flush feature?
Yes
Results in Memory are erased
No

SLOT MACHINE

BACKGROUND OF THE INVENTION

Field of the Invention

The present invention relates generally to slot machine devices. More particularly the present invention relates to a slot machine device providing strategic and advantageous modes of game play.

Description of Related Art

Slot machines are extremely popular with those attending casinos. Slot machines provide enjoyable game play at a pace determined by the player, and can be enjoyed for an extended period of time by the player. Slot machines are highly profitable for casinos and other gambling establishments. As such there is an incentive to keep slot machine game play creative and exciting. Further, it is advantageous to a casino to incentivize faster game play and/or larger bets. This faster game play and larger betting may also be more exciting and enjoyable to a player. Further still, actual and/or perceived advantages provided in game play to a player may further increase both profits to the casino and enjoyment to the player.

Therefore, what is needed is a slot machine device that may provide additional game play modes that provide a strategic element to game play and also an actual and/or perceived advantage to the player.

SUMMARY OF THE INVENTION

The subject matter of this application may involve, in some cases, interrelated products, alternative solutions to a particular problem, and/or a plurality of different uses of a single system or article.

In one aspect, a method for conducting a slot machine game is provided. The method utilizes an electronic slot machine having a data processor in communication with a display, a user interface, and a computer memory. The computer memory is configured to store electronic representations of slot machine reels and the markers thereon for presentation by the display. The display may consist of a window through which physical reels, manipulated by stepper motors, can be viewed, or a video display device on which virtual reels can be simulated. The memory further stores program instructions executable by the data processor to conduct the steps of the method.

The method of slot machine game play begins with the player inputting a quantity of money. The player may then coordinate bets and strategy with the input money. The player then triggers the actuator, typically an arm or button, or other method, which initiates the spinning of the reels. During the spin, or perhaps at another time in another aspect of the invention, the processor determines if the results for this cycle had been predetermined by a previous cycle. If the results for this cycle have been predetermined by a previous cycle, those predetermined results are presented to the player. If the results for this cycle have not been predetermined by a previous cycle, the processor instructs the Random Number Generated to generate new results for this cycle and these new results are presented to the player. Regardless of whether new results are generated for this cycle, or whether results for this cycle had been previously determined, the processor directs the Random Number Generator to create results for the next cycle. The results for the next cycle are stored in memory and will be presented to the player after this cycle completes.

It should be noted that the results for the next cycle, which are stored in memory, may be stored indefinitely or for a shorter period of time. For example, in one implementation, the results for the next cycle may remain in memory indefinitely. In another implementation, the results for the next cycle may be stored for a specified amount of time, perhaps one hour. In yet other implementations, the results may be stored for ten minutes, thirty minutes, two hours, one day, or any other period of time as defined by the programming of the slot machine.

After the results have been generated (for this cycle, if needed and for the next cycle every time), the results for this cycle are presented to the player through the manipulation of the reels, and all winnings for this cycle, if any, are presented to the player.

After the payout for this cycle, if any, is presented to the player, but before the player inputs money for the next cycle, the data processor checks the results for the next cycle that are stored in memory. If the results stored in memory indicate a win, the player receives a visual and/or audio indication that the next cycle will result in a win. If the results stored in memory indicate a loss, no notification is given to the player. In this implementation, the player is only notified if the next cycle will result in a win, and no notification is given in the event that the next cycle will result in a loss. In another implementation, the Notice feature may give a separate, distinct indication that the next cycle will be a loss. With this Notice feature, the player is informed, prior to inputting money for the next cycle, whether or not the next cycle will be a win or a loss.

There are many ways in which the Notice feature can be implemented. In one aspect of the invention, the Notice feature may be a simple flashing of a light. In another aspect of the invention, the Notice feature may take the form of an audio signal such as a bell or whistle. In another aspect of the invention, the Notice feature may take the form of a complicated, animated video clip. And in still another aspect of the invention, the Notice feature may take the form of some other combination of visual and/or audio cues.

In another aspect, a slot machine is provided. The slot machine is an electronic slot machine having a data processor in communication with a display, a user interface, and a computer memory. The computer memory is configured to store electronic representations of slot machine reels and the markers thereon for presentation by the display, and program instructions executable by the data processor to conduct the game play of the machine. In addition to traditional slot machine game play, this slot machine provides optional unique game play features. These features may include: A Notice feature which informs a player if the next cycle will be a win or a loss; a Flush feature allowing a player to discard a losing cycle; and a Do-Over feature, allowing a player to replay an unsatisfactory cycle. These features may be turned on and off by the slot machine player. Further, the data processor of the slot machine may be configured to automatically adjust a payout option and payout percentage depending on what features are activated to ensure a constant or approximately constant payout rate is maintained, regardless of game play features selected.

BRIEF DESCRIPTION OF THE DRAWINGS

FIG. 2 provides a flow chart of an embodiment of the present invention.

FIG. 3 provides a flow chart of another embodiment of the present invention.

DETAILED DESCRIPTION

Figure 1:
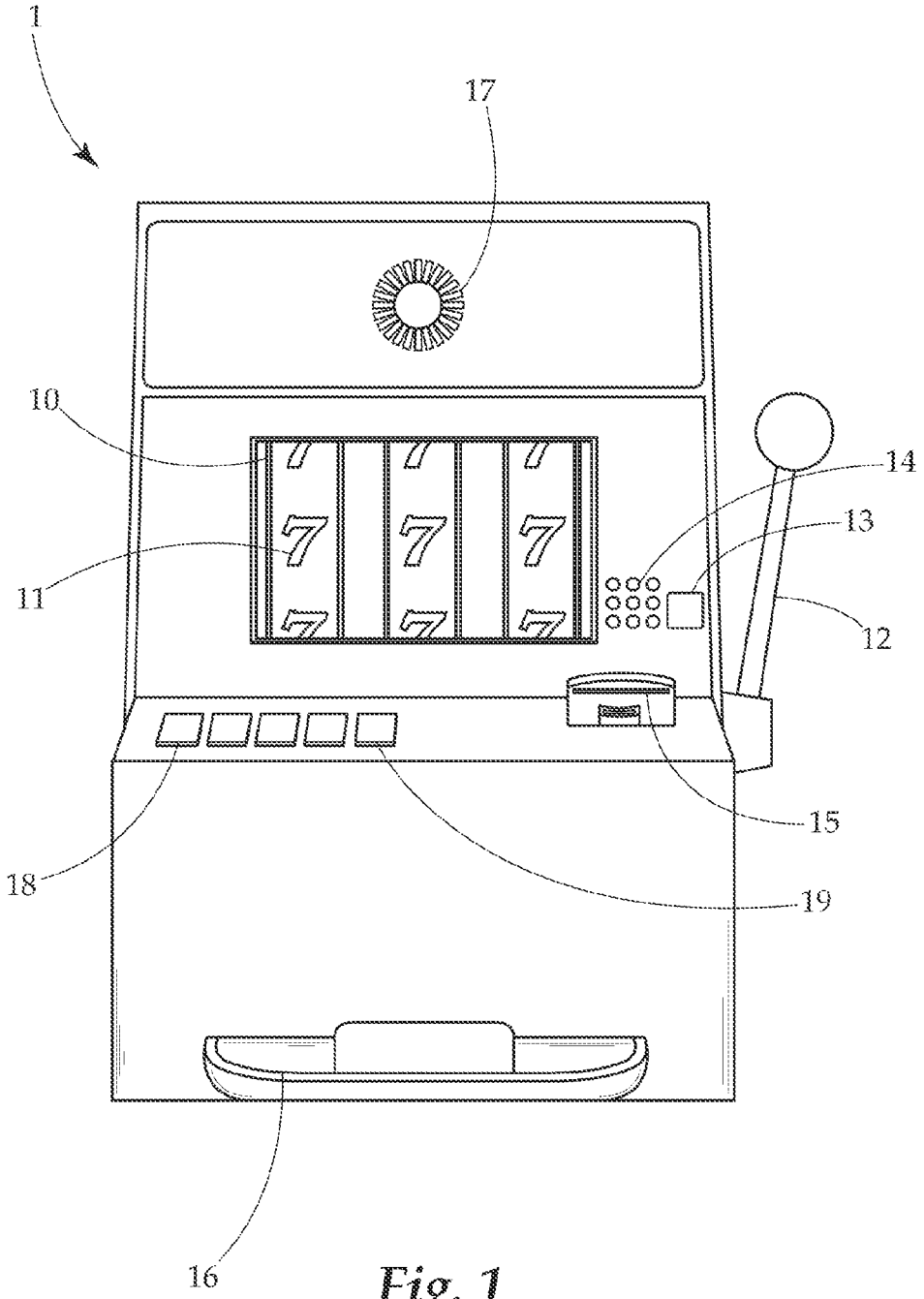
FIG. 1 provides a view of an embodiment of the slot machine of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a slot machine device providing a unique operation, payout scheme, and structure. This slot machine provides optional, unique game play features. These features may include: A Notice feature which informs a player if the next cycle will be a win or a loss; a Flush feature allowing a player to discard a losing cycle; and a Do-Over feature, allowing a player to replay a cycle if they do not like the results of the previous cycle. These features may be turned on and off, and the slot machine may be configured to automatically adjust a payout option depending on what features are activated.

The slot machine is formed generally by a machine body, which provides a housing and structure for the slot machine. On and in this body is an interface, which allows input to the machine and output to a player of the machine.

The input includes a money or payment input (generally referred to herein as a money input), which may be a card reader, cash input slot, electronic payment input, or the like. A betting input is also present as part of the interface. The betting input allows a user to select a bet quantity and/or type, such as a minimum bet, maximum bet, or a bet in between. The interface further comprises an actuator that initiates a spinning of the reels of the slot machine. This may be a physical lever or other structure, such as a button that triggers the movement. In fully electronic machines, the actuator may just trigger a spinning of virtual reels on a screen, and in mechanical machines, the actuator physically triggers a spinning of the reel or reels. A display output is provided as part of the interface. This may be a computer display screen, or a window allowing viewing into the spinning reel or reels. Further, within the housing and as part of a control system of the slot machine is a randomizer. The randomizer is configured to provide a random result. This randomizer may be electronic, such as a programmed computerized random number generating module carried out by a data processor, or may be a mechanical structure that controls a spinning of a reel or reels. For the purposes of the present invention, this randomizer (device, function, module-depending on embodiment) may be programmable and/or adjustable to control a payout percentage and payout size based on a selected type of game play. In other embodiments, control over the payout percentage and payout size may be a function of the programmed logic of the processor. The interface further includes a payout output, which provides a way for a player to receive a payout. This may be through a printed ticket, electronic credit, cash output, and the like.

In electronic versions of the present invention, a computer having a computerized data processor controls the game play of the machine. The randomizer may be a programmed module, such as an instruction set executable by a data processor, stored in a memory. The computer may be further configured to receive inputs from the interface, and provide output through at least a display screen and, optionally, through other outputs such as lights and/or speakers. In one embodiment, the display may be a touch screen, such that it may also receive inputs. Such electronic versions of the present invention may include computerized slot machines, and may also include embodiments such as fully digital implementations such as fully computerized versions playable on a tablet, smartphone, kiosk, desktop or laptop computer, as well as network based embodiments, internet embodiments, or application embodiments.

In further detail, an embodiment of the computer controlling operation of an electronic version of the slot machine contemplated herein may comprise a data processor such as a microchip, microprocessor, and the like. The processor may be in communication with a display, a player interface, as described above, and a memory device. The memory device may contain the randomizer module, as well as electronic representations of the reel and symbols on the reel, for presentation by the display. The memory may further contain program instructions, in addition to the randomizer module's instructions. These instructions are executable by the data processor to conduct the steps of the game play, as will be detailed below.

In addition to the functions and structure described above, the slot machine of the present invention may have a number of game play enhancements.

In one embodiment, the slot machine may comprise a game play option of a Notice feature which informs a player if the next cycle will be a win or a loss. The Notice feature provides an indication, through the display of the interface, if the next cycle will be a win or a loss. The amount of the win is, typically, not presented. This game play option may always be on in one embodiment, or may be activated and/or deactivated by the player, or by the slot machine owner/operator based on certain conditions, in another embodiment. The presentation by the display may be on a computerized display screen, on a light or other visual indicator, or by a speaker or other audio indicator, or a combination thereof.

In one embodiment, the Notice feature may be integral to game play, with no added consideration required. In other embodiments, additional consideration may be required to use the Notice feature, such as an input of additional payment, requiring a specific bet amount, requiring faster game play (as set by a timer programmed into the computer), the feature is only available after a pre-determined amount of game play (such as 30 uninterrupted cycles), and the like.

In another embodiment, the slot machine may comprise a game play option of a Flush feature. This feature may stand on its own, but will more likely be used in conjunction with the Notice feature, in varying embodiments. The Flush feature allows a player to provide an input to the machine instructing it to discard a losing cycle.

In operation, the Flush feature allows a player to provide an input to the slot machine through the interface that, after receiving a feedback from the Notice feature that the next cycle will not be a win, flushes that result from the game. Upon receiving a Flush feature input, the microprocessor may erase the results stored in the memory. In most embodiments, the Notice feature will be temporarily disabled after the Flush feature is activated, though the Notice feature may be active in some embodiments.

In some embodiments, the Flush feature may be integral to game play, with no added consideration required. In other embodiments, additional consideration may be required to use the Flush feature, such as an input of additional payment, requiring a specific bet amount, requiring faster game play (as set by a timer programmed into the computer), the feature is only available after a pre-determined amount of game play (such as 30 uninterrupted cycles), and the like.

In yet another embodiment, the slot machine may comprise a game play option of a Do-Over feature. This feature may stand on its own, or may be used in conjunction with the Notice feature and/or Flush feature. The Do-Over feature allows a player to replay a cycle if they do not like the results of the previous cycle.

In operation, the Do-Over feature allows a player to provide an input to the slot machine through the interface that, after receiving a feedback after a cycle has completed of a loss or an undesired win, allows a player to replay the cycle without inputting additional money. In most embodiments, the Notice feature will not activate after the Do-Over feature is activated, though it may in some embodiments. Upon receiving a Do-Over feature input, the microprocessor may be configured to rerun the cycle, providing for a new set of results to be generated.

In some embodiments, the Do-Over feature may be integral to game play, with no added consideration required. In other embodiments, additional consideration may be required to use the Do-Over feature, such as an input of additional payment, requiring a specific bet amount, requiring faster game play (as set by a timer programmed into the computer), the feature is only available after a pre-determined amount of game play (such as 30 uninterrupted cycles), and the like.

Using these game play enhancements, the user may continue repeating game play until they decide to stop.

In some embodiments, one or more of the three listed game play options may be activated and deactivated based on an input to the computer. Upon activation or deactivation of any of the game play options, the processor module may make adjustments to account for increases or decreases in player advantages, to provide an even or approximately even payout rate over time. In other words, upon activation of one of the game play enhancements, a player's odds of winning may be increased. Based on this increase in odds, the processor module adjusts win frequency, payout amounts, or both allowing a casino or slot machine owner to achieve a reasonable profit. The microprocessor may be capable of determining through calculation an appropriate payout rate by the randomizer module, or the different game play option payout rates may be pre-set and programmed into the memory. Further, an administration mode of the computer may allow an owner to manually adjust or input a payout rate and payout table, allowing additional customization.

Other factors may also contribute to the desire to adjust the payout percentage of the slot machines. These factors include, but are not limited to, the time of day, the day of the week, the occurrence of special holidays or events, the number of players on the casino floor or the subjective will of the casino owner or operator.

One aspect of the invention may also include a non-transitory computer readable medium having instructions allowing and instructing the data processor to carry out the steps required during game play of the slot machine, as described herein. This non-transitory computer readable medium may be stored within the housing of the slot machine, or may be accessible through an electronic communication system such as a network and/or internet connection.

Turning now to FIG. 1, an embodiment of the slot machine of the present invention is shown. The slot machine 1 comprises a number of interface elements, as well as buttons or other inputs to activate the Notice feature, Flush feature, and Do-Over feature, all of which are present on the slot machine 1. The slot machine 1 comprises a payment input 15, actuator 12, shown here as a lever (though could be a button or other actuating structure), and a payout slot 16 to receive a payout when ending game play, if any. A display 10 is in communication with various computerized internal components as detailed above. The display provides a visual feedback of cycle results using representations of spinning reels and the indicators 11 thereon. An audio output speaker 14 is positioned facing where a player would sit and can provide audio output to the player. A selection button 13 allows a player to input betting information, strategy, and the like. This button 13 may be a single button or a number of different buttons allowing various inputs into the slot machine 1 for game play. It should be understood that all of the inputs and outputs are in communication with the computerized system as noted above. Namely, the microprocessor, which can receive inputs and provide outputs depending on operation.

Game play enhancements of the present invention are present on the slot machine 1. The Notice feature 17 is, in this embodiment, a flashing light. This light will flash when the next cycle is determined to be a win, and will be deactivated when the next cycle is determined to be a loss. It should be understood though that the Notice feature may be displayed to a player in any number of ways, and is not limited to the flashing light shown. A plurality of buttons such as those of 18 and 19 allow a user to utilize the Flush feature 18, and the Do-Over feature 19. Upon activation of these buttons, the feature will be used, and any additional consideration required will be prompted on the display as programmed by the microprocessor.

FIG. 2 shows a flow chart of an embodiment of game play on the slot machine having a Notice game play feature. In this view, the game play begins with the player inputting a quantity of money. The player may then coordinate bets and strategy. The player then pulls the handle, or pushes a button, to actuate the spin. At this point, the processor determines whether or not the results for this cycle have been determined by a previous cycle. If the results for this cycle have been determined by a previous cycle, the processor uses those results. If the results for this cycle have not been determined by a previous cycle, the process instructs the randomizer to create results that will be used for this cycle. Regardless of whether the results for this cycle have been predetermined or not, results for the next cycle are also created and placed into memory to be displayed by the Notice feature after this cycle completes.

Now that results for this cycle, as well as results for the next cycle have been determined, the processor instructs the reels to stop at the appropriate positions, thereby informing the player whether this cycle has resulted in a win or a loss. If a win, the appropriate payout is provided.

After the appropriate payout, if any, is presented to the player, but before the player inputs money, or makes betting decisions for the next cycle, the Notice feature retrieves the results for the next cycle from memory and informs the player whether or not the next cycle will result in a win. In this embodiment, the Notice feature informs the player of a win with a flashing light, although many other forms of notification, including video and/or audio cues, are possible.

FIG. 3 shows a flow chart of an embodiment of game play on the slot machine having a Notice game play feature, as well as a Flush game play feature and a Do-Over game play feature. In this view, the game play begins with the player inputting a quantity of money. The player may then coordinate bets and strategy. The player then pulls the handle, or pushes a button, to actuate the spin. At this point, the processor determines whether or not the results for this cycle have been determined by a previous cycle. If the results for this cycle have been determined by a previous cycle, the processor uses those results. If the results for this cycle have not been determined by a previous cycle, the processor instructs the randomizer to create results that will be used for this cycle. Regardless of whether the results for this cycle have been predetermined or not, results for the next cycle are also created and placed into memory to be displayed by the Notice feature after this cycle completes.

Now that results for this cycle, as well as results for the next cycle have been determined, the processor instructs the reels to stop at the appropriate positions, thereby informing the player whether this cycle has resulted in a win or a loss. If a win, the appropriate payout is provided.

After the appropriate payout, if any, the player has the opportunity to use the Do-Over feature. If the result of that cycle was unsatisfactory, for example, if a wager of $3 was made and the result was a win of $1, the net affect being a loss of $2, the player may choose to use the Do-Over feature. The player may press a button to activate the Do-Over feature. The slot machine will recognize that the Do-Over feature has been activated and respond by removing any winnings from the cycle, in this case the $1, and activate the reels with the original $3 wager. An additional $3 wager is not taken from the player. The original $3 wager is played again.

In the case where the Do-Over feature was not activated, the player is instead presented with information about the next cycle's win or loss by the Notice feature. In the case that the Notice feature indicates that the next cycle will not be a win, the player may choose to activate the Flush feature. If the player chooses to activate the Flush feature, and presses the appropriate button to do so, the processor will recognize that the Flush feature has been activated and flush the next cycle's results from memory. Therefore, when the next cycle is run, there will be no results predetermined and the machine will generate new results for that cycle.

Figure 4:
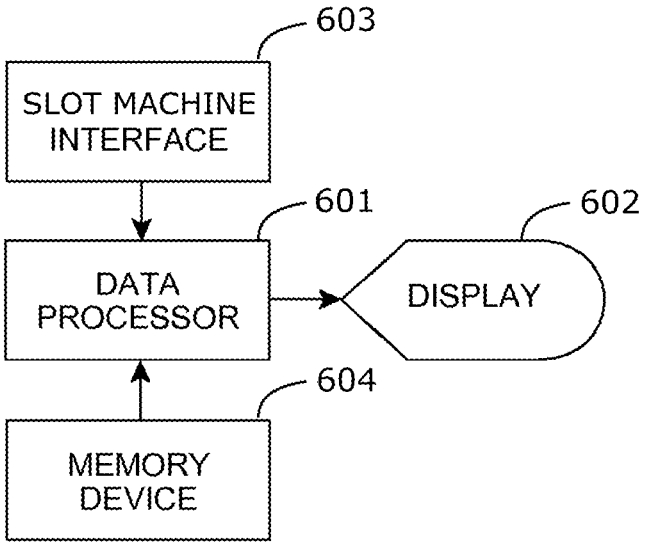
FIG. 4 provides a simplified schematic view of an embodiment of the computerized communication of the slot machine.

FIG. 4 provides a simplified schematic view of an embodiment of the computerized communication of the slot machine. The slot machine interface 603 has elements as described above. These elements communicate with data processor 601. The data processor 601 is further in communication with a memory device 604 which stores instructions for the data processor 601, as well as calculations and determinations by the data processor 601. A display 602 provides a visual output of the results, and any other information that the data processor 601 is instructed to output.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A method for conducting a slot machine game utilizing an electronic slot machine having a data processor in communication with a display, a user interface, and a computer memory, wherein the computer memory is configured to store electronic representations of slot machine reels and the markers thereon, and program instructions executable by the data processor to conduct steps comprising:

receiving a money input from a player through the user interface of the slot machine, the data processor recording the amount of money input;

receiving an input from the player regarding betting strategy through the user interface, the betting strategy comprising receiving a bet ranging from a minimum bet to a maximum bet by the data processor through the user interface;

randomizing a cycle result by a randomizing module of the data processor as instructed by the memory, the randomizing determining two elements of information: if a next cycle will be a win; and if it will be a win, how much a payout will be, the two elements of information being based on a randomized selection based on a payout programming stored in the memory;

storing the results of the randomizing in the memory;

presenting the information element of if the next cycle will be a win to the player before the player activates the next cycle through the user interface;

receiving a spin actuation through the user interface;

displaying a spin comprising a moving of the reel and the markers thereon, the spin ending with a randomized display of the markers by the data processor, and presented on the display;

presenting the determined payout if the cycle was determined a win and presenting on the display that there is no payout if the cycle was determined a loss, after the step of displaying the spin; and after the step of presenting the payout or no payout on the display, allowing a player to select at least one of a new play, or to end play.

2. The method of claim 1 further comprising the steps of:

receiving a Flush request by the player through the user interface after the step of presenting the information element of if the next cycle will be a win to the player before the player activates the next cycle, wherein the Flush request instructs the data processor to erase the determined result information and determined payout of the randomizing module, and to repeat the randomizing the cycle result to generate a second set of elements of information: if the next cycle will be a win; and if it will be a win, how much a payout will be.

3. The method of claim 1 further comprising the steps of:

receiving a Do-Over request by the player through the user interface after the step of presenting the determined payout if the cycle was determined a win, and presenting that there is no payout if the cycle was determined a loss, wherein the Do-Over request instructs the data processor to erase the determined win/loss information and determined payout, and to reclaim the previous payout, if any, and replay the bet.

4. The method of claim 1 further comprising:

receiving at least one of a Flush request and a Do-Over request by the user interface;

wherein the receiving of a Flush request by the player through the user interface after the step of presenting the information element of if the next cycle will be a win to the player before the player activates the next cycle, wherein the Flush request instructs the data processor to erase the determined win/loss information and determined payout of the randomizing module, and to repeat the randomizing the cycle result to generate a second set of elements of information: if the next cycle will be a win; and if it will be a win, how much a payout will be; and wherein the receiving of a Do-Over request by the player through the user interface after the step of presenting the determined payout if the cycle was determined a win, and presenting that there is no payout if the cycle was determined a loss, wherein the Do-Over request instructs the data processor to erase the determined win/loss information and determined payout, to reclaim the previous payout, if any, and replay the bet.

5. The method of claim 4 further comprising the step of requiring, by the data processor, a specific bet amount as the bet input through the user interface to enable at least one of the Flush request and Do-Over request.

6. The method of claim 4 wherein the data processor carries out a timer displayed on the display, the data processor requiring the step of receiving the spin actuation through the user interface before an expiration of the timer.

7. The method of claim 4 further comprising the step of requiring, by the data processor, an additional payment through the user interface after the step of receiving the at least one of the Flush request and Do-Over request.

8. The method of claim 1 wherein the payout programming of the memory communicated to the data processor is adjustable.

9. The method of claim 8 wherein the payout programming is selected to be one of a plurality of pre-programmed data sets stored in the memory based on an input regarding game play type of the user by the user interface.

10. The method of claim 8 wherein the payout programming is automatically adjustable by the data processor to provide an even payout rate by the slot machine regardless of an input regarding game play type of the player by the user interface.

11. A slot machine for conducting a slot machine game comprising:

a data processor;

a display in communication with the data processor;

a user interface in communication with the data processor; and a computer memory, wherein the computer memory is configured to store electronic representations of slot machine reels and the markers thereon, and program instructions executable by the data processor to conduct the steps of:

receiving a money input from a player through the user interface of the slot machine, the data processor recording the amount of money input;

receiving an input from the player regarding betting strategy through the user interface, the betting strategy comprising receiving a bet ranging from a minimum bet to a maximum bet by the data processor through the user interface;

randomizing a cycle result by a randomizing module of the data processor as instructed by the memory, the randomizing determining two elements of information: if the next cycle will be a win; and if it will be a win, how much a payout will be, the two elements of information being based on a randomized selection based on a payout programming stored in the memory;

storing the results of the randomizing in the memory;

presenting the information element of if the next cycle will be a win to the player before the user activates the next cycle through one of the display and the user interface;

receiving the spin actuation through the user interface;

displaying a spin comprising a moving of the reel and the markers thereon, the spin ending with a randomized display of the markers, by the data processor, and presented on the display;

presenting the determined payout if the cycle was determined a win and presenting that there is no payout if the cycle was determined a loss, after the step of displaying the spin; and after the step of presenting the payout or no payout, displaying the next cycle win/loss information and allowing a player to select at least one of a new play, or to end play.

12. The slot machine of claim 11 wherein the program instructions further conduct the step of:

receiving a Flush request by the player through the user interface after the step of presenting the information element of if the next cycle will be a win to the player before the player activates the next cycle, wherein the Flush request instructs the data processor to erase the determined win/loss information and determined payout of the randomizing module, and to repeat the randomizing the cycle result to generate a second set of elements of information: if the next cycle will be a win; and if it will be a win, how much a payout will be.

13. The slot machine of claim 11 wherein the program instructions further conduct the step of:

receiving a Do-Over request by the player through the user interface after the step of presenting the determined payout if the cycle was determined a win, and presenting that there is no payout if the cycle was determined a loss, wherein the Do-Over request instructs the data processor to erase the determined win/loss information and determined payout, to reclaim the previous payout, if any, and to replay the bet.

14. The slot machine of claim 11 wherein the program instructions further conduct the step of:

receiving at least one of a Flush request and a Do-Over request by the user interface;

wherein the receiving of a Flush request by the player through the user interface after the step of presenting the information element of if the next cycle will be a win to the player before the player activates the next cycle, wherein the Flush request instructs the data processor to erase the determined win/loss information and determined payout, and to repeat the randomizing the cycle result to generate a second set of elements of information: if the next cycle will be a win; and if it will be a win, how much a payout will be; and wherein the receiving of a Do-Over request by the player through the user interface after the step of presenting the determined payout if the cycle was determined a win, and presenting that there is no payout if the cycle was determined a loss, wherein the Do-Over request instructs the data processor to erase the determined win/loss information and determined payout, to reclaim the determined payout, and to replay the bet.

15. The slot machine of claim 14 wherein the program instructions further conduct the step of requiring, by the data processor, a specific bet amount as the bet input through the user interface to enable at least one of the Flush request and Do-Over request.

16. The slot machine of claim 14 wherein the program instructions further conduct the step of requiring, by the data processor, an additional payment through the user interface after a step of receiving at least one of the Flush request and Do-Over request.

17. The slot machine of claim 11 wherein the payout programming of the memory communicated to the data processor is adjustable.

18. The slot machine of claim 17 wherein the payout programming is selected to be one of a plurality of pre-programmed data sets stored in the memory based on an input regarding game play type of the user by the user interface.

19. The slot machine of claim 17 wherein the payout programming is automatically adjustable by the data processor to provide an even payout rate by the slot machine regardless of an input regarding game play type of the player by the user interface.

20. A slot machine for conducting a slot machine game comprising:

a data processor;

a display in communication with the data processor;

a user interface in communication with the data processor; and a computer memory, wherein the computer memory is configured to store electronic representations of slot machine reels and the markers thereon, and program instructions executable by the data processor to conduct the steps of:

receiving a money input from a player through the user interface of the slot machine, the data processor recording the amount of money input;

receiving an input from the player regarding betting strategy through the user interface, the betting strategy comprising receiving a bet ranging from a minimum bet to a maximum bet by the data processor through the user interface;

randomizing a cycle result by a randomizing module of the data processor as instructed by the memory, the randomizing determining two elements of information: if the next cycle will be a win; and if it will be a win, how much a payout will be, the two elements of information being based on a randomized selection based on a payout programming stored in the memory;

storing the results of the randomizing in the memory;

receiving the spin actuation through the user interface;

displaying a spin comprising a moving of the reel and the markers thereon, the spin ending with a randomized display of the markers, by the data processor, and presented on the display;

presenting the determined payout if the cycle was determined a win and presenting that there is no payout if the cycle was determined a loss, after the step of displaying the spin;

receiving a Do-Over request by the player through the user interface after the step of presenting the determined payout if the cycle was determined a win, and presenting that there is no payout if the cycle was determined a loss, wherein the Do-Over request instructs the data processor to erase the determined win/loss information and determined payout, to reclaim the previous payout, if any, and to replay the bet; and allowing a player to select at least one of a new play, or to end play.

* * * * *